US010001729B2

(12) United States Patent
Lidai et al.

(10) Patent No.: US 10,001,729 B2
(45) Date of Patent: Jun. 19, 2018

(54) DEVELOPING SECTIONS FOR DIGITAL PRINTING PRESSES, CONTROLLERS AND METHODS

(71) Applicant: HP INDIGO B.V., Amstelveen (NL)

(72) Inventors: Uri Lidai, Nes Ziona (IL); Shmuel Borenstain, Nes Ziona (IL); Eyal Negreanu, Nes Ziona (IL)

(73) Assignee: HP Indigo B.V., Amstelveen (NL)

( * ) Notice: Subject to any disclaimer, the term of this patent is extended or adjusted under 35 U.S.C. 154(b) by 0 days. days.

(21) Appl. No.: 15/326,102

(22) PCT Filed: Jul. 31, 2014

(86) PCT No.: PCT/EP2014/066561
§ 371 (c)(1),
(2) Date: Jan. 13, 2017

(87) PCT Pub. No.: WO2016/015777
PCT Pub. Date: Feb. 4, 2016

(65) Prior Publication Data
US 2017/0205732 A1 Jul. 20, 2017

(51) Int. Cl.
*G03G 15/00* (2006.01)
*G03G 15/10* (2006.01)

(52) U.S. Cl.
CPC ..... *G03G 15/108* (2013.01); *G03G 15/104* (2013.01); *G03G 2215/0658* (2013.01)

(58) Field of Classification Search
CPC ..... G03G 15/1605; G03G 15/065; G03G 15/104; G03G 15/043; G03G 15/0815
See application file for complete search history.

(56) References Cited

U.S. PATENT DOCUMENTS 5,043,749 A * 8/1991 Punater ..... G03G 15/065 101/211
5,455,668 A 10/1995 DeBock et al.
5,500,720 A 3/1996 Karasawa
5,666,591 A 9/1997 Taya
5,940,665 A 8/1999 Domoto et al.
6,243,543 B1 6/2001 Nozawa
6,745,002 B2 6/2004 Nakashima et al.
7,039,343 B2 5/2006 Sasaki et al.
(Continued)

FOREIGN PATENT DOCUMENTS

JP H04338771 11/1992

OTHER PUBLICATIONS

HP Indigo Digital Offset Colour Technology, (Research Paper), Mar. 5, 2012. <http://www8.hp.com/us/en/commercial-printers/graphic-arts.html>.

*Primary Examiner* — Walter L Lindsay, Jr.
*Assistant Examiner* — Jessica L Eley
(74) *Attorney, Agent, or Firm* — HP Inc. Patent Department

(57) ABSTRACT

A developing section for a digital printing press includes a controller to control a development unit such that a configuration of the development unit is to be in a first state or a second state based on a determination by the controller comparing a location of a portion of the surface of a photo imaging member presented to the development unit with a location of a transition between an image portion and a portion of the surface of the photo imaging member not in the image portion.

15 Claims, 8 Drawing Sheets

(56) References Cited

U.S. PATENT DOCUMENTS

| | | | | |
|---|---|---|---|---|
| 7,481,509 | B2 | 1/2009 | Staelin et al. | |
| 2002/0101493 | A1 | 8/2002 | Tanaka et al. | |
| 2005/0180766 | A1 | 8/2005 | Shin et al. | |
| 2006/0098999 | A1 | 5/2006 | Nishida et al. | |
| 2007/0048011 | A1* | 3/2007 | Okubo | G03G 15/1605 399/128 |
| 2011/0103814 | A1 | 5/2011 | Toyama et al. | |
| 2011/0120327 | A1* | 5/2011 | Araki | G03G 13/28 101/130 |
| 2012/0148310 | A1 | 6/2012 | Nelson et al. | |

* cited by examiner

DEVELOPING SECTIONS FOR DIGITAL PRINTING PRESSES, CONTROLLERS AND METHODS

CROSS-REFERENCE TO RELATED APPLICATION

This application is a U.S. National Stage Application of and claims priority to International Patent Application No. PCT/EP2014/066561, filed on Jul. 31, 2014, and entitled "DEVELOPING SECTIONS FOR DIGITAL PRINTING PRESSES, CONTROLLERS AND METHODS," which is hereby incorporated by reference in its entirety.

BACKGROUND

Digital printing presses allow a hardcopy image to be produced on a substrate directly from digital data, such that no "analogue" intermediate media is required. Offset printing presses make use of an intermediate member to transfer an image from a plate member to a substrate. Offset printing may reduce wear on the plate member and may improve image quality by providing a transfer member that is able to conform to the topology of the substrate.

BRIEF DESCRIPTION OF THE DRAWINGS

Examples of the invention are further described hereinafter with reference to the accompanying drawings, in which:

FIG. 8*b* illustrates an example with the trailing edge of the image portion coincident with the trailing edge of the photo imaging member.

DETAILED DESCRIPTION

Figure 1:
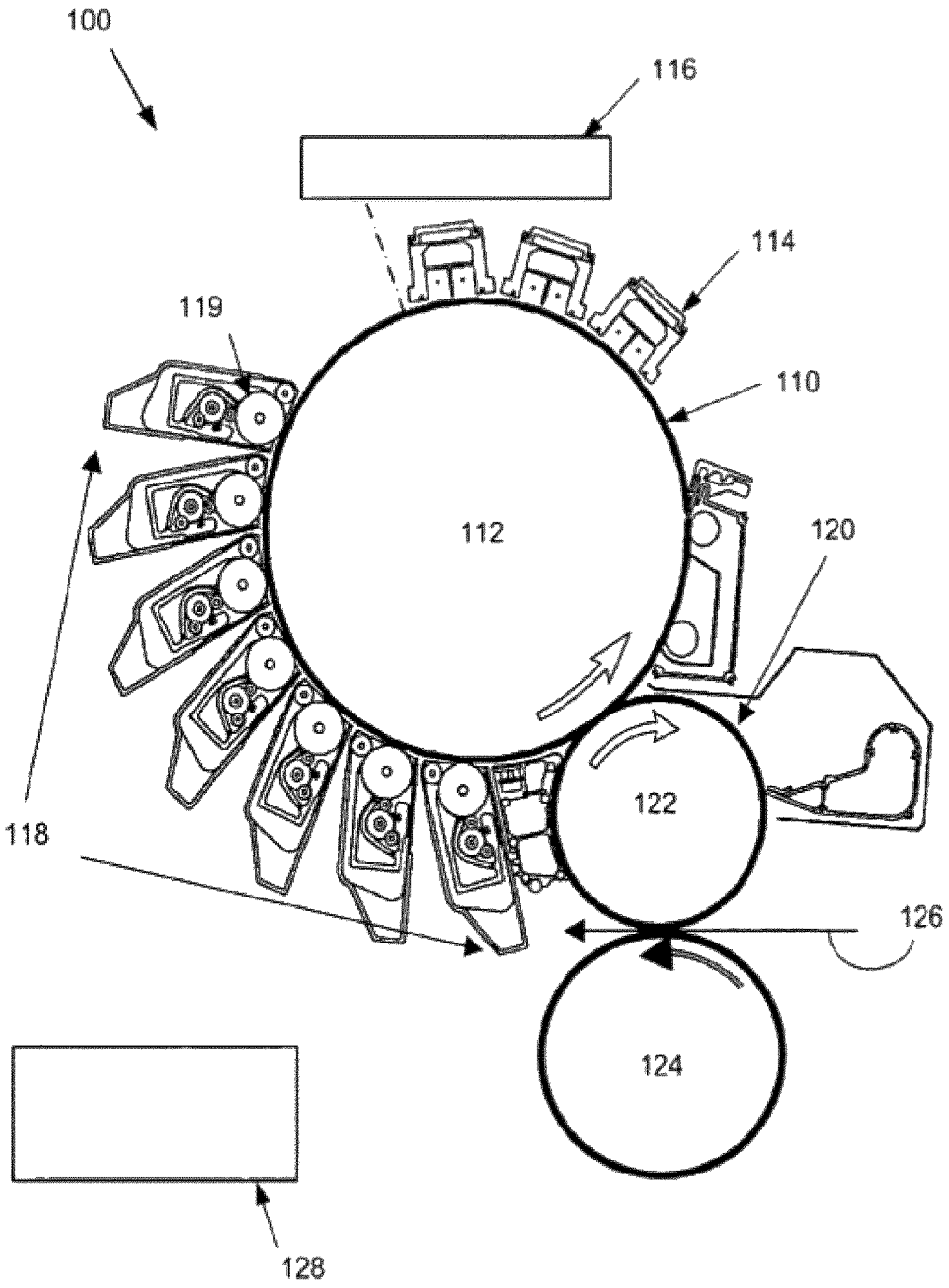
FIG. 1 illustrates an exemplary digital printing press.

FIG. 1 illustrates an exemplary digital printing press 100. The digital printing press 100 includes a photo imaging member 112, e.g. a Photo Imaging Plate (PIP) drum 112 with a PIP foil wrapped around it, and a plurality of development units 118, e.g. Binary Ink Development (BID) units, disposed about the photo imaging member 112. The surface 110 of the photo imaging member 112 may include a photoconductive material.

Each development unit 118 may contain a single ink, but the different development units 118 may contain inks of different colors. For example, the seven development units

118 of FIG. 1 may contain a total of seven different inks. More or fewer development units 118 may be provided.

The digital printing press 100 may produce a print as follows. The surface 110 of the photo imaging member 112 is charged by a charging assembly 114, such as a Scorotron assembly. As the photo imaging member 112 is rotated, a writing head 116 produces a laser beam that discharges specific areas on the surface 110 of the photo imaging member 112. These discharged areas define a latent image.

One development unit 118 applies ink to the foil 110 during each rotation of the photo imaging member 112. A development unit 118 is engaged with (e.g. moved near to or into contact with) the surface 110 of the photo imaging member 112. The development unit 118 may include a developer that is charged to a lower potential than the charged areas on the surface 110 of the photo imaging member 112, and a larger potential than the discharged areas on the surface 110 of the photo imaging member 112. Charged ink in the development unit 118 is attracted to the discharged areas on the surface 110 of the photo imaging member 112. Ink is transferred from the developing unit 118 (e.g from a developer roller 119 of the developing unit 118) to the discharged areas. Ink should not be transferred to those areas of surface 110 having higher potential than the developer roller 119. In this manner, ink is selectively deposited on the surface 110 of the photo imaging member 112. As the surface 110 of the photo imaging member 112 is rotated, a color plane of the image is formed on the surface 110 of the photo imaging member 112.

With each additional rotation of the photo imaging member 112, the writing head 116 discharges specific areas on the surface 110, and another development unit 118 applies ink to the discharged areas. In this manner, a developed image is formed on the foil 110.

The developed image is transferred from the surface 110 of the photo imaging member 112 to an Intermediate Transfer Member (ITM) 122. The ITM 122 may include a blanket 120 wrapped around the drum of the ITM 122, such that the image is transferred to the blanket 120. The transfer of the developed image may be achieved through electrical and mechanical forces. The blanket 120 may be charged and heated to raise the temperature of the ink on the blanket 120. The increase in temperature causes the ink to swell and acquire a gelatin-like form. With the help of another drum 124, the developed image is transferred from the blanket 120 to a substrate 126 (i.e., a print medium).

A controller 128 may be provided to control one or more of the elements of FIG. 1. For example, the controller 128 may control the photo imaging member 112 and the development units 118. The controller may be implemented in hardware, software, firmware or a combination of these. The controller 128 include be a processor.

In some arrangements, development units 118 that are not currently intended to transfer ink to the photo imaging member 112 may be disengaged (e.g. moved away) from the surface 110 of the photo imaging member 112 to prevent (or reduce) transfer of ink to the photo imaging member 112 from those development units 118. Accordingly, during a period in which only a single development unit 118 is to transfer ink to the surface 110 of the photo imaging member 112 (e.g. during a single rotation of the photo imaging member), the remaining development units 118 may be withdrawn away from the surface 110 of the photo imaging member 112.

The surface 110 of the photo imaging member 112 may include a seam, for example running along the surface 110 of the photo imaging member 112 parallel with an axis of the photo imaging member 112. In some examples, the seam is not appropriate for carrying a latent image, and a development unit 118 applying ink to the surface 110 of the photo imaging member 112 may be disengaged from the surface 100 of the photo imaging member 112 when the seam passes the development unit.

The photo imaging member 112 is illustrated in FIG. 1 as a drum, but alternative structures may also be used. For example, the photo imaging member 112 may be implemented as a belt instead of as a drum. Similarly, the ITM 122 need not be a drum, and may be implemented as a belt, for example.

In the arrangement of FIG. 1, rotation of the photo imaging member 112 is used to present different parts of the surface 110 of the photo imaging member 112 for processing by the various processing units (e.g. by the charging assembly 114, writing head 116, development units 118). However, any suitable relative movement between the photo imaging member 112 and the respective processing units may be used.

Figure 2A:
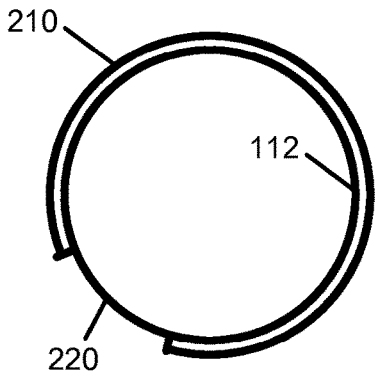
FIG. 2*a* illustrates an image portion and a non-image portion on a photo imaging member.
Figure 2B:
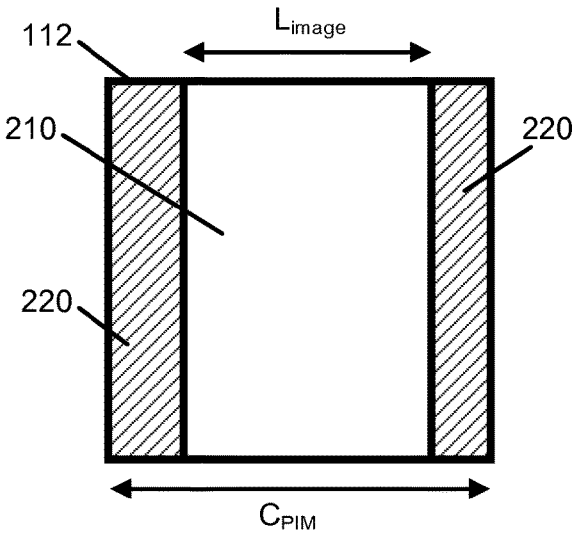
FIG. 2*b* shows an alternative view of the photo imaging member of FIG. 2*a*.
Figure 2C:
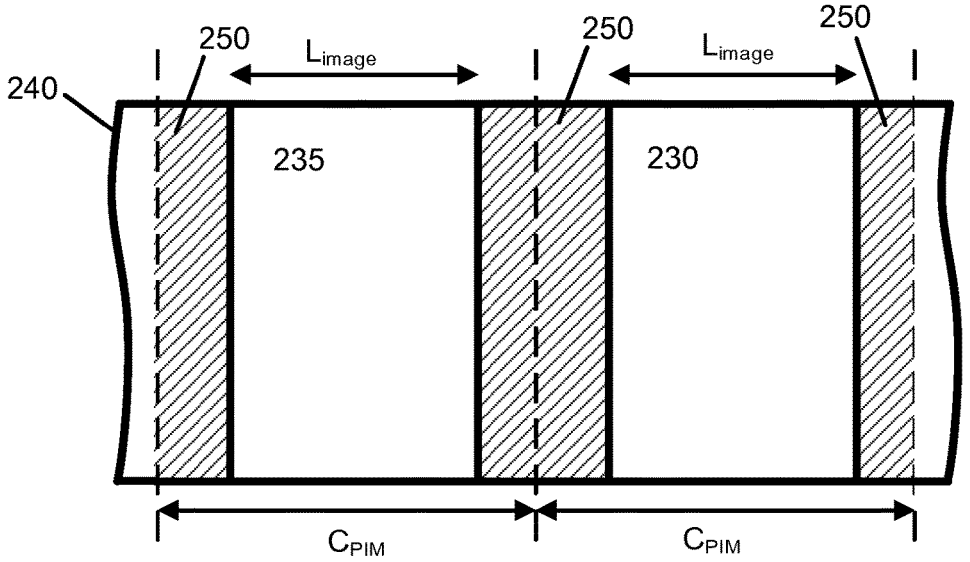
FIG. 2*c* shows a substrate bearing two spreads produced by the photo imaging member of FIGS. 2*a* and 2*b*.

As shown schematically in FIGS. 2*a-c*, the latent image 210 may be shorter (measured along the surface 110) than the length of the surface 100 of the photo imaging member 112 along a direction of relative motion between the photo imaging member 110 and the development units 118. For example, in the arrangement of FIG. 1, the latent image may be shorter, in a direction along the circumference of the photo imaging member 112, than the circumference of the photo imaging member 112. FIG. 2*a* illustrates this case schematically, with the photo imaging member 112 having a portion corresponding with the latent image 210 and a non-image portion 220, where the latent image is not formed. FIG. 2*b* shows a flattened surface of the photo imaging member 112, with the image portion 210 (corresponding with the latent image) and the non-image portion 220. The length of the latent image $L_{image}$ and the circumference $C_{PIM}$ of the photo image member 112 are also shown. FIG. 2*c* shows an example of the substrate after repeated cycles of printing have applied the same image to the substrate twice. FIG. 2*c* shows two spreads on a web substrate 240, each spread has the same length as the photo imaging member 112 ($C_{PIM}$) and corresponds to a single transfer from the surface 110 of the photo imaging member 112 to the ITM 122. In the example of FIG. 2*c*, each spread includes one image 230, 235. As shown in FIG. 2*c*, the image regions 230, 235 of the substrate 240 are separated by non-image regions 250.

Figure 3A:
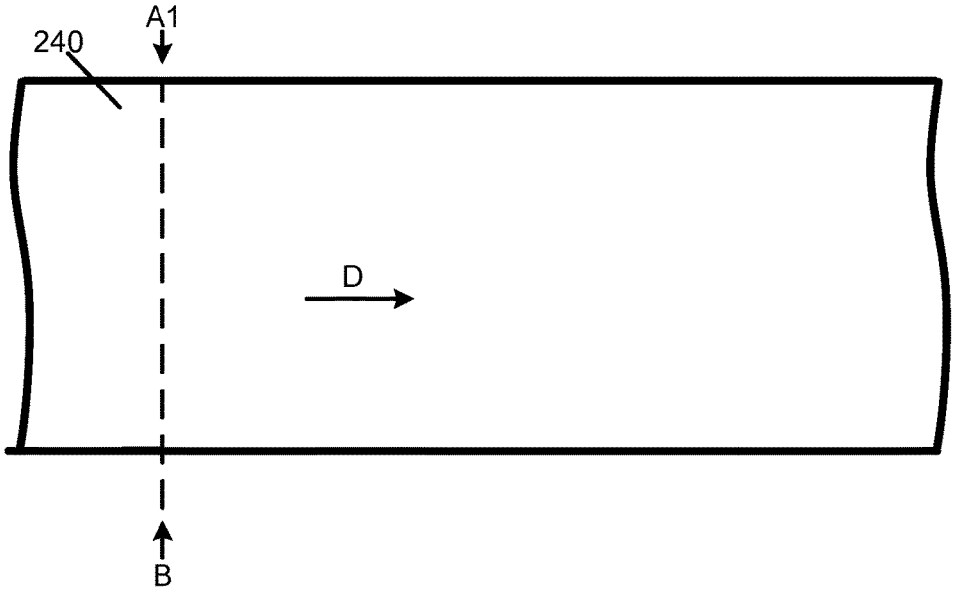
FIGS. 3*a* to 3*d* show various stages of printing on a substrate.

In some applications, it may be desirable for consecutive image regions 230, 235 of the substrate 240 to be continuous, without a non-image region 250 between them. In order to avoid, or reduce, the non-image region 250, the substrate 240 may be rewound, such that after the substrate 240 has been advanced by an amount equal to the circumference $C_{PIM}$ of the photo image member (or more generally by an amount equal to the length of the photo image member 112 in a direction of the relative motion between the photo image member 112 and the development unit 118) the substrate feed direction may be reversed, and the substrate moved back, or rewound, such that the next image region 230, 235 will begin immediately after the end of the previous image region 230, 235. This is shown schematically in FIGS. 3*a-d*. FIG. 3*a* shows a substrate 240, with A1 being a point, fixed relative to the substrate, corresponding to the leading edge of the photo imaging member 112 (i.e. a point that will receive any ink at the leading edge of the surface 110 of the photo imaging member 112). B indicates a fixed point relative to the printing device, such as, the point at which the ITM 122 meets the substrate. D shows a direction in which the substrate is fed.

Figure 3B:
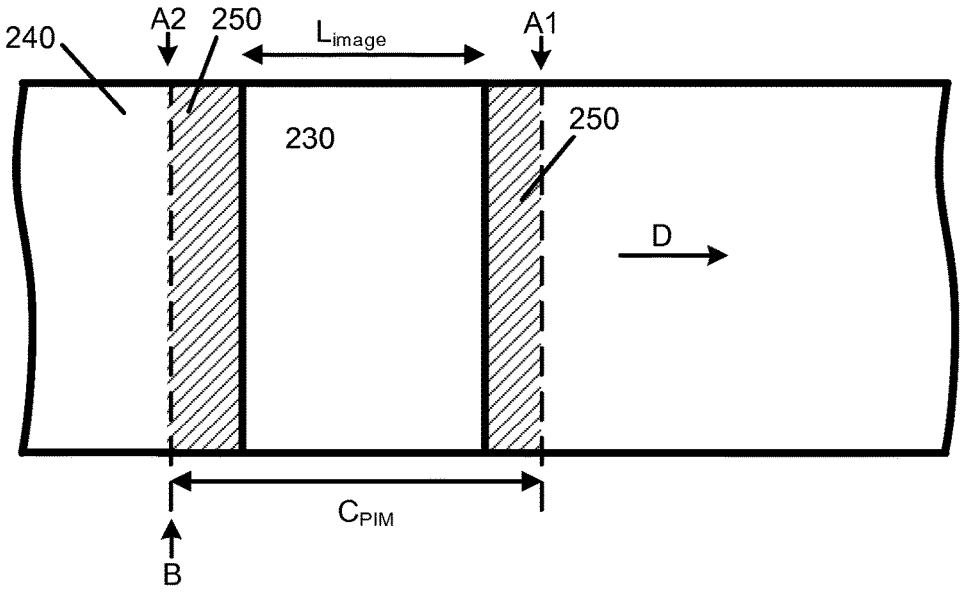

FIG. 3*b* shows the substrate after one cycle of the photo imaging member 112 (e.g. one cycle of the photo imaging member transferring ink to the ITM 122) and a first spread has been printed, beginning at point A1. The substrate 240 has been fed in direction D by a distance equal to the length $C_{PIM}$ of the photo imaging member 112, and image 230 has been produced on the substrate 240. Since the image 230 has a shorter length than the photo imaging member 240, non-image areas 250 are also formed. A2 corresponds to the point, fixed relative to the substrate 240 corresponding to the trailing edge of the surface 110 of the photo imaging member 112. The trailing edge of the surface 110 may be the same point as the leading edge of the surface 110, where the surface 110 forms a closed loop. In some examples, there may be a non-useable portion of the surface 110, such as a portion around a seam. The non-useable portion of the surface 110 may separate the trailing edge from the leading edge. Herein, references to the length $C_{PIM}$ of the surface 110 do not include any non-useable portion. So, for example, where the photo imaging member is a drum having a non-useable portion, $C_{PIM}$ will be smaller than the actual circumference of the drum, with the actual circumference being the sum of $C_{PIM}$ and the length of the non-useable portion.

Figure 3C:
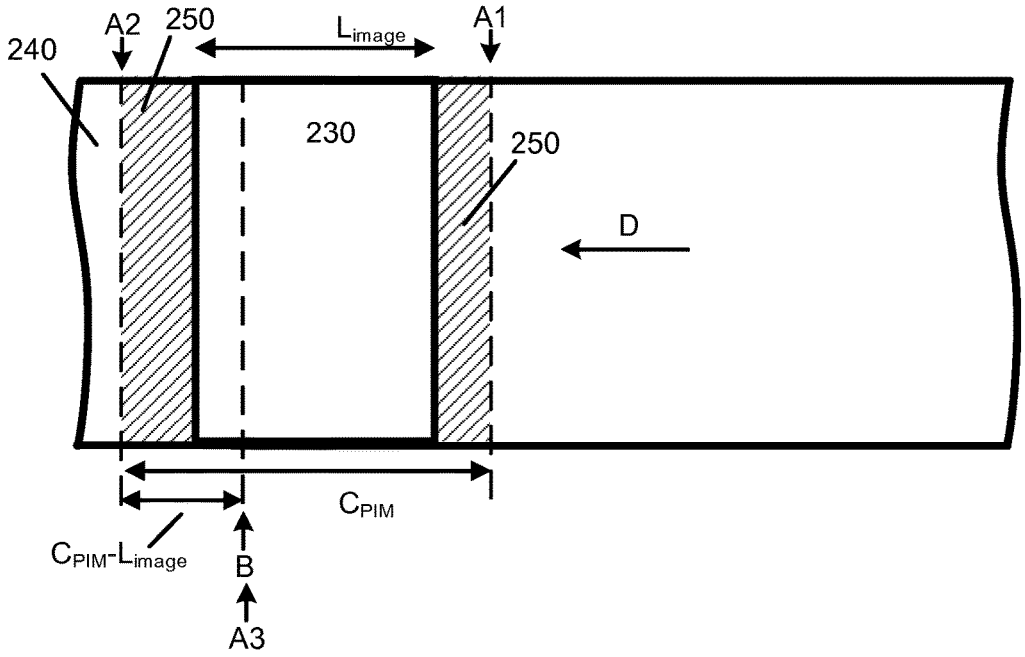

In FIG. 3*c*, the feed direction of the substrate 240 is reversed, and the substrate 240 is rewound by a distance equal to $C_{PIM}$-$L_{image}$. Point A3 is fixed relative to the substrate 240, and corresponds to the leading edge of the next cycle of the photo imaging member 112.

Figure 3D:
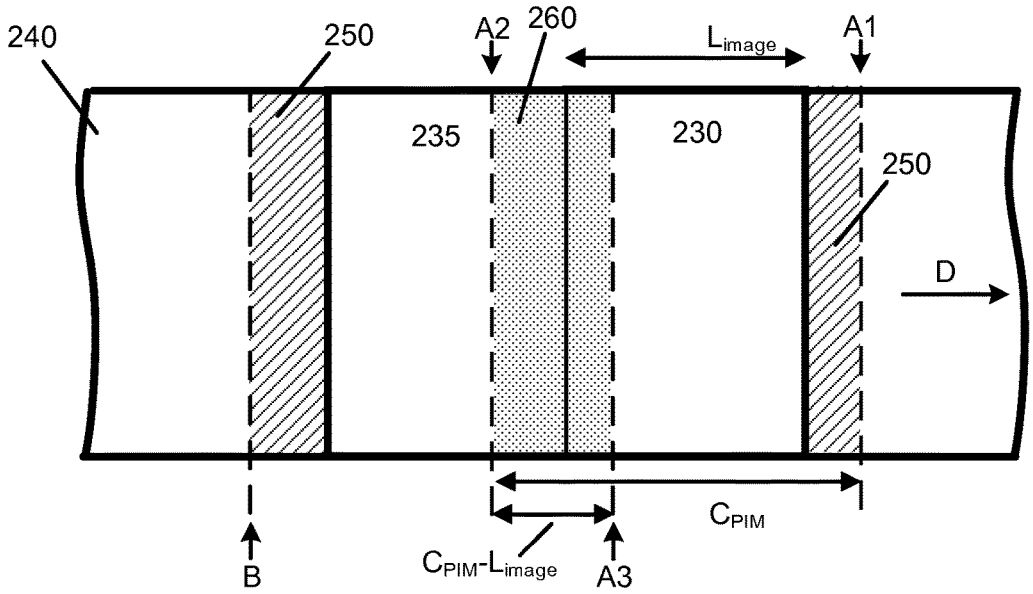

FIG. 3*d* shows the substrate 240 after a second spread has been printed. The second spread includes a second image 235 that is printed immediately adjacent to the first image 230, without a gap, and resulting in a continuous print across the two images. However, the second spread overlaps with the first spread in an overlap region 260. The overlap region 260 corresponds to an overlap between (i) the images 230, 235, and (ii) portions of non-image area 250, with the overlap region 260 located around the edge at which the two images 230, 235 meet. The overlap region 260 has a length (in the substrate feed direction) of $C_{PIM}$-$L_{image}$, and is a result of the rewinding of the substrate, as described in relation to FIG. 3*c*.

In principle, electrical forces should block transfer of ink into unexposed areas of the photo imaging member, e.g. outside the borders of the latent image. However, in practice a small amount of ink may be transferred into these unexposed areas, due to some ink particles not being fully charged, for example. Herein, unexposed areas of the photo imaging member that are not intended to receive a particular ink may be referred to as the background, and particles of that ink in these regions may be referred to as background ink.

In an arrangement as illustrated in FIGS. 3*a-d*, the overlap region 260 receives background ink twice, once from each spread. Accordingly, each part of the overlap region 260 receives background ink once from one of the images 230, 235 and once from the non-image areas 250. This results in a doubling of the amount of unwanted background ink in the overlap region 260, and a doubling of the strength of the background ink in the overlap region 260. This may lead to an unacceptable degradation of image quality in the overlap region 260. This degradation may be particularly noticeable with particular inks, such as white or silver liquid electrophotography inks, for example.

In some examples, a repeat length, $L_{repeat}$, may be defined for a print job. The repeat length may be defined as the separation between onsets of two subsequent images 230, 235 on the substrate (measured along a feed direction of the substrate 240). Typically, the repeat length is equal to the image length, $L_{image}$, such that subsequent images are immediately adjacent, without overlapping, so as to form a continuous series of images. However, this is not necessarily the case, and the repeat length may be greater or less than the image length. In the example of FIGS. 3*a-d*, the image length was assumed to be equal to the repeat length. However, if the image length and repeat length differed, the result would be the substrate 240 being rewound by an amount $C_{PIM}$-$L_{repeat}$ instead of $C_{PIM}$-$L_{image}$, and the overlap region 260 having a length of $C_{PIM}$-$L_{repeat}$. Where the repeat length is greater than the image length, subsequent images will have gaps between them, with the gaps having length $L_{repeat}$-$L_{image}$. Where the repeat length is less than the image length, the images 230, 235 will overlap, with the overlap having a length of $L_{image}$-$L_{repeat}$.

According to some examples, background ink associated with a non-image region 250 of the substrate 240 (or a non-image portion 220 of the surface 110 of the photo imaging member 112) may be reduced or eliminated. The development unit 118 may be arranged to change between a first state and a second state depending on whether an image portion 210 or a non-image portion 220 of the surface 110 of the photo imaging member 112 is presented to the development unit 118 for development. When the image portion 210 is presented to the development unit 118, the development unit 118 is in the first state, in which ink may be transferred to the surface 110 of the photo imaging member 112 as normal. When the non-image portion 220 is presented to the development unit 118, the development unit 118 is in the second state, in which ink is prevented from being transferred to the surface 110 of the photo imaging member 112. Accordingly, the amount of ink transferred to the surface 110 of the photo imaging member 112 in the non-image region 220 will be reduced or eliminated, such that the amount of background ink in the overlap region 260 of the substrate 240 is reduced. According to these examples, prevention of ink transfer in the non-image portion 220 of the surface 110 of the photo imaging member 112 does not rely only on the electrostatic forces (such as may be used on to prevent unwanted ink transfer within the borders of the image), but also (or alternatively) changes a state of the development unit 118 based on whether an image portion 210 or a non-image portion 220 of the surface 110 of the photo imaging member 112 is presented to the developing unit 118. Accordingly, these examples may provide improved image quality in an overlap region of a substrate 240.

Controller 128 may control a configuration of the development unit 118 such that the development unit 118 is in a first state when the controller 128 determines that an image area of the surface 110 of the photo imaging member 112 is presented to the development unit for development, and such that the configuration of the development unit 118 is in a second state when the controller 128 determines that a non-image area of the surface 110 of the photo imaging member 112 is presented to the development unit. In some examples the controller 128 may be configured to control the development unit 118 to be in a first or second state based on a determination comparing a location of the portion of the surface 110 of the photo imaging member 112 presented to the development unit 118 with a location of a transition between the image portion 210 and the non-image portion 220.

Controller 128 may be arranged to determine an image portion of the surface 110 of the photo imaging member 112 corresponding with an extent of the image to be developed, with the extent being measured in the direction of motion of the photo imaging member 112 relative to the development unit 118. The extent of the image is the extent along the surface 110 of the photo imaging member 112 in the direction of movement of the photo imaging member 112 relative to the development unit 118.

The controller 128 may be further arranged to control the development unit, such that a configuration of the development unit is in a first state when the controller 128 determines that the portion of the surface 110 of the photo imaging member 112 presented to the development unit 118 is in the image portion According to some examples, the controller may receive data describing the image to be developed, and may determine whether an image portion or a non-image portion is presented to the development unit 118 based on the received data.

In some examples, the received data may describe a repeat length associated with the image to be developed, and the determination of whether an image portion or non-image portion is presented to the development unit 118 may be based on the repeat length. In some examples, the determination may assume that the repeat length is equal to an image length (i.e. a length of the image to be developed). In some arrangements, the image length may not be readily available to the controller 128, and where the repeat length is available to the controller 128, approximation of the image length by the repeat length permits the reduction of background ink in the overlap region without requiring further information (e.g. provided by a user).

In some examples the controller may receive an adjustment value, representing an adjustment to the repeat length. In such arrangements the image length may be determined (or approximated) based on the repeat length and the adjustment value. The adjustment value may be a manually supplied adjustment.

According to some examples, the image portion of the surface 110 of the photo imaging member 112 corresponds with a portion of the surface 110 bearing a latent image.

Figure 4A:
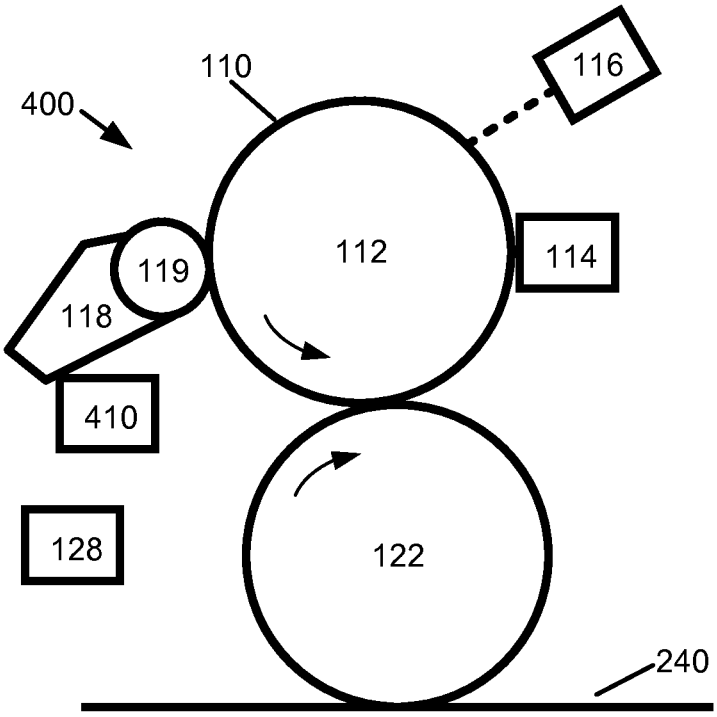
FIGS. 4*a* and 4*b* show a development unit in different states.
Figure 4B:
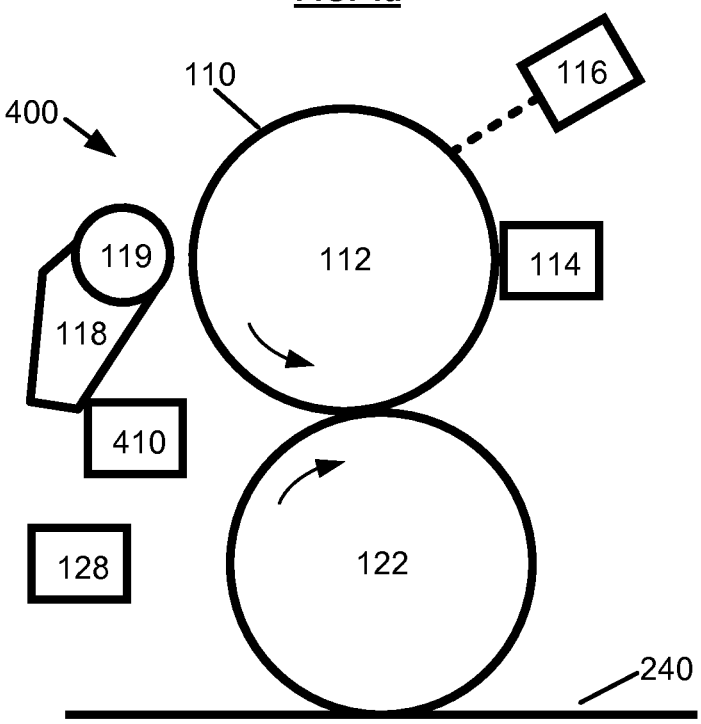

FIGS. 4*a* and 4*b* illustrate a developing section 400 for a digital printing press in accordance with some examples. The developing section 400 includes a photo imaging member 112 and a development unit 118. As described in relation to FIG. 1, a latent image may be created on the surface 110 of the photo imaging member 112 (e.g. by a charging assembly 114 and writing head 116). The development unit 118 is arranged to develop ink onto the photo imaging member 112 by applying ink to the surface 110 of the photo imaging member 112. The development unit 118 may selectively apply ink to the latent image on the surface 110 of the photo imaging member 112. For simplicity only one development unit 118 is shown, but additional development units 118 may be provided.

The photo imaging member 112 moves relative to the developing unit 118 in order to present different portions of the surface 110 of the photo imaging member 112 for development by the development unit.

FIG. 4*a* shows the development unit 118 in the first state. In this state, the development unit 118 is engaged with the photo imaging member 112, and is able to apply ink to the surface 110 of the photo imaging member 112. For example, a developer roller 119 of the development unit 118 may be pressed against the surface 110 of the photo imaging member 112 so that ink may be transferred from the developer roller 119 to the surface 110 of the photo imaging member 112.

FIG. 4*b* shows the development unit 118 in the second state. In this state, the development unit 118 is disengaged from the photo imaging member 112, and is not able to apply ink to the surface 110 of the photo imaging member 112. For example, the developer roller 119 of the development unit 118 may be moved away from the surface 110 of the photo imaging member 112, such that ink may not be transferred from the roller to the surface 110 of the photo imaging member 112.

An actuator 410 may be provided to cause the movement of the development unit 118 between the engaged and disengaged states.

According to some examples, not all of the development units apply ink to the surface 110 at the same time; for example, there may be one active development unit applying ink to the surface 110 at a particular time, and the remaining development units may be inactive, and not applying ink to the surface 110. When the active development unit has completed applying ink to the photo imaging member (e.g. the active development unit has applied ink through a complete cycle of the photo imaging member), the active development unit may become inactive, and one of the inactive development units may become active. In some examples, inactive development units may be moved away from the surface 110 to prevent undesirable ink transfer. In some examples, in the second state the development unit may be in the same state as another development unit that is not currently to apply ink to the surface 110 of the photo imaging member 112. That is, in the second state, an active development unit may be moved away from the surface 110 in the same or similar manner as an inactive development unit. Accordingly, in some examples, this arrangement may be implemented by making use of functionality that may be provided in the device for another purpose, providing additional functionality while reducing or avoiding the need for structural modifications.

In some printing presses, the development unit may be positioned away from the surface 110 when a seam portion of the surface 110 is presented to the development unit, the seam portion being a region around a seam in the surface 110. According to some examples, the second state may correspond to the development unit being positioned away from surface 110, using the same or a similar mechanism to the mechanism for positioning the development unit away from the seam portion of the surface 110, such that the development unit 118 is withdrawn from the surface 110 in the second state. Accordingly, in some examples, this arrangement may be implemented by making use of functionality that may be provided in the device for another purpose, and may reduce or eliminate the need for structural modifications.

Figure 5:
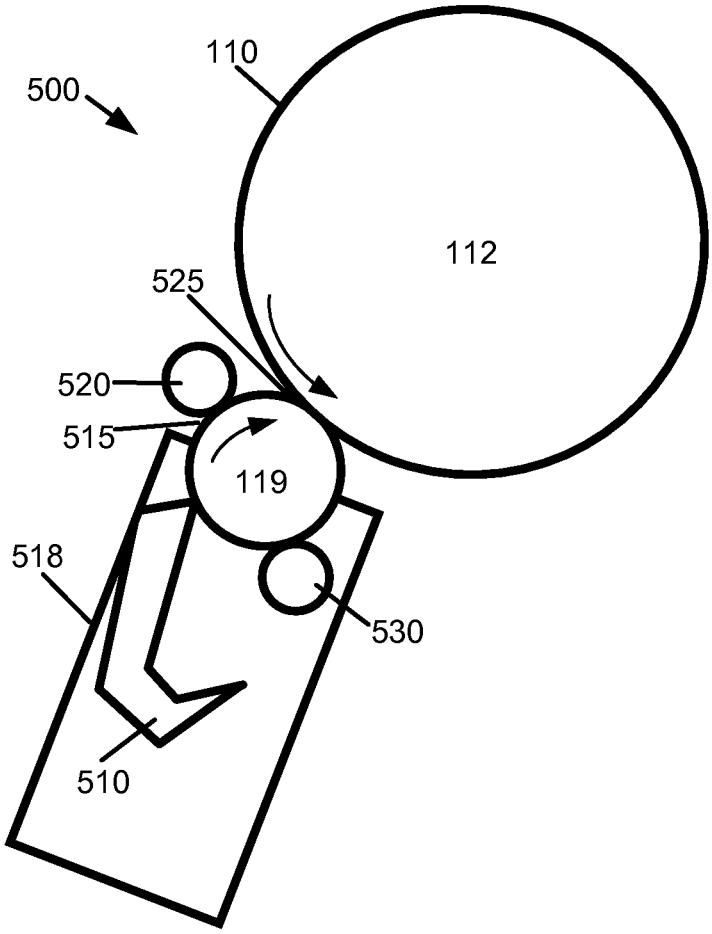
FIG. 5 shows an arrangement according to some examples.

FIG. 5 shows an arrangement 500 having a development unit 518 according to some examples. The development unit 518 may include one or more components for applying a voltage to ink in the developer to charge the ink. In the example of FIG. 5 the development unit 518 includes an electrode 510. Ink is channeled along the electrode 510 from an ink tank of the development unit 518. The electrode 510 is charged and applies a voltage to ink as it is channeled along the electrode 510, thereby charging the ink.

The development unit 518 of FIG. 5 further includes a developer roller 119, which rotates in a clockwise direction in this example. In some examples, the developer roller may be charged. Charged ink is transferred from the electrode 510 to the developer roller 119. The ink on the developer roller 119 passes through the nip 515 between the developer roller 119 and squeegee roller 520. This compacts and smoothes the ink on the developer roller 119. In some examples, the squeegee roller 520 may be charged. The ink is then selectively transferred to the surface 110 of the photo imaging member 112 at the nip 525 between the developer roller 119 and the photo imaging member 112. Ink remaining on the developer roller after passing through the nip 525 reaches the cleaner roller 530 and is transferred electrically to the cleaner roller, which may be charged, and is then returned to the ink tank of the development unit 518.

The selective transfer of charged ink from the development unit 518 to the surface 110 of the photo imaging member 112 is achieved electrically, with the latent image (defined by discharged portions of the surface 110 of the photo imaging member 112) being attractive to the charged ink particles and areas not corresponding to the latent image (being defined by charged portions on the surface 110 of the photo imaging member 112, either within the image region 230 or the non-image region 250) presenting a repulsive, or rejecting, vector to the charged ink, substantially preventing transfer of ink.

In some arrangements, the charges on the developer roller 119 and squeegee roller 520 are intended to control the charged ink (e.g. by electrostatic attraction) and do not significantly change the charge carried by the ink.

According to the arrangement of FIG. 5, the voltage applied to the ink is changed between the first and second state of the development unit 518, such that the repulsive vector is increased in the second state relative to the first state (assuming the same charge on the portion of the surface 110 of the photo imaging member 112 in both states, such as the charge of areas not corresponding to the latent image).

By increasing the repulsive vector in the second state (i.e. when the photo imaging member 112 presents a non-image region 250 of its surface 110 to the development unit 518), the transfer of ink may be reduced in the non-image region 250, leading to a reduction of background ink in the overlap region.

In some examples, the portion of the surface 110 of the photo imaging member 112 that is presented to the development section 518 may be the portion of the surface 110 that is in the nip 525, or at the start of the nip 525 (this may also be the case in examples in accordance with FIG. 4).

According to some examples, the first state is a normal printing state, and the second state is a state associated with the non-image region 250 being in the nip 525. The following table gives exemplary voltages of components in the development unit 118 in the first state. Voltage 1 gives the voltage relative to an exposed portion of the photo imaging member (abbreviated as PIP in Table 1), and Voltage 2 gives the voltage relative to the developer roller 119. Exposed and Unexposed denote the portions of the surface 110 of the photo imaging member 112 that have been exposed nor not exposed, respectively.

TABLE 1

| Component | Voltage 1 [V] - Relative voltage to exposed areas on PIP/abs voltage | Voltage 2 [V] - Voltage relative to Developer roller voltage |
|---|---|---|
| Exposed - latent image | 0 | +450 |
| Cleaner roller 530 | −250 | +200 |
| Developer roller 119 | −450 | 0 |
| Squeegee roller 520 | −750 | −300 |
| Unexposed - non latent image | −900 | −450 |
| Electrode 510 | −1450 | −1000 |

The transition between the first and second state need not occur at when the boundary between the image region 230 and the non-image region 250 is in the nip 525. For example, the transition between the first and second state may occur at time $T_{1-2}=T_{NIR}-\Delta T_{e-d}$, where $T_{1-2}$ is the time of the transition between the first and second states, $T_{NIR}$ is the time at which the boundary between the image region 230 and the non-image region 250 is at the start of the nip 525, and $\Delta T_{e-d}$ is the time taken for ink at the end of the electrode (i.e. at the point of transfer from the electrode to the developer roller 199) to reach the start of nip 525. This example, the second state may differ from the first state by applying a different voltage to the electrode 510, e.g. by reducing the voltage on the electrode 510 (that is, increasing the absolute voltage difference between the electrode and the developer roller), such that the ink on the electrode 510 in the second state is more strongly charged. The more strongly charged ink will arrive at the nip 525 at approximately the same time as the boundary between the image region 230 and the non-image region 250. The more strongly charged ink will be repelled more strongly (have a greater repulsion vector), relative to ink charged in the first state, from the unexposed portions of the surface 110 of the photo imaging member 112. Accordingly, less ink will be transferred to the photo imaging member 112 in the non-image region 250.

As in the example above, the transition between the first and second state may occur before the boundary between the image region 230 and non-image region 250 meets the nip 525. The transition may occur when the boundary between the image region 230 and non-image region 250 is a predetermined temporal or spatial separation from the nip 525. In the above example, the transition occurs at a temporal separation of $\Delta T=\Delta T_{e-d}$.

The second state may include multiple states. In some examples each of the multiple states is arranged to transfer less ink to a non-exposed area than the first state.

In the above example, the reduced (e.g. more negative, leading to a greater difference between the electrode voltage and the developer roller voltage) electrode voltage may relate to a first sub-state of the second state, and a second sub-state of the second state may follow the first sub-state. For example, a transition between the first and second sub-states may occur at time $T_{21-22}=T_{NIR}-\Delta T_{nip}$. Where $T_{21-22}$ is the time of the transition between the first and second sub-states of the second state, and $\Delta T_{nip}$ is the time taken for ink to pass from the start of the nip 545 to the end of the nip 545. In the second sub-state, the electrode voltage may be increased (relative to the first sub-state) and the voltage of the developer roller 119 may be increased, such that the repulsive vector is further increased, and ink transfer to the photo imaging member 118 is further inhibited. In some examples, the voltage difference between the electrode 510 and developer roller 119 may be the same in the first and second sub-states, such that the change in voltage of the electrode 510 (e.g. relative to a fixed potential, such as ground) between the first and second sub-states is the same as the change in voltage of the developer roller 119 (e.g. relative to a fixed potential, such as ground) between the first and second sub-states.

According to some examples, the electrode voltage does not influence the repulsion vector. In some arrangements the electrode voltage may be changed with the developer roller voltage, such that the difference between the electrode voltage and the developer roller voltage is the same in the first and second states. In other arrangements the electrode voltage and/or developer roller voltage may be changed independently.

In some arrangements, the transition to the second sub-state may occur at a time $T_{21-22}=T_{NIR}-\Delta T_{21-22}$, where $\Delta T_{21-22}$ is a specified time interval that may be greater or smaller than $\Delta T_{nip}$. By initiating the transition a short time before $T_{NIR}$, the transition may be complete, or essentially complete before the non-image region 250 is in the nip 525, avoiding an initial portion of the non-image region 250 (neighboring the image region 230) from receiving a higher level of background ink before the transition to the second sub-state is complete (or sufficiently complete). In some examples, a reduction in image quality due to the transition to the second sub-state while the image region 230 is in the nip 525 may be avoided where $\Delta T_{21-22}$ is sufficiently short.

The voltages of the electrode 510 and/or squeegee 530 relative to the voltage of developer roller 119 may be controlled to make the ink on the developer roller 119 thinner, tackier and/or more highly charged. These properties of the ink at the nip 525 can reduce the background development on the photo imaging member. Moreover, in the non-image region 250, it is not necessary to ensure that ink can be transferred to the photo imaging member 112, since there is no image to develop in that region 250. This relaxes constraints on the properties of the ink.

The voltage of the developer roller 119 relative to the surface 110 of the photo imaging member 119 affects the electrical rejection vector of the non-image (charged) photo imaging member 112. In the non-image region 250, reducing the voltage of the developer roller 119 (increasing the difference between the voltage of the developer roller 119 and the voltage of the photo imaging member 119) will reduce background ink transfer to the development roller 119.

Table 2 gives examples of component voltages in the second state. As with table 1, voltage 1 is the voltage relative to an exposed portion of the photo imaging member. The second column gives the change in voltage between the first and second states, with the voltages measured relative to an exposed portion of the photo imaging member. Without the loss of generality, the voltage relative to the photo imaging member may be considered as an absolute voltage if we consider the exposed (latent image portion) of the photo imaging member to be 0V.

Table 2 additionally gives voltage 3, the voltage relative to the developer roller 119 in the second state. The fourth column in Table 2 gives the voltage difference between the first and second states, with the voltages measured relative to the developer roller 119 in the respective state.

TABLE 2

| Component | Voltage 1 [V]- relative to PIP/abs voltage | Voltage diff[V] - abs voltage difference from 1st state to 2nd state/ difference in relative voltage to PIP | Voltage 3 [V] - relative to Vdev in 2nd state | Voltage diff[V] - difference in relative voltage to developer voltage from 1st state to 2nd state |
|---|---|---|---|---|
| Developer roller 119 | −300 | +150 V | 0 V | +150 V |
| Squeegee roller 520 | −800 | −50 V | −500 V | −200 V |
| Electrode 510 | −1500 | −50 V | −1200 V | −200 V |

Relative to the values in table 1, in table 2 the electrode has a larger voltage difference relative to the developer roller, leading to the ink being more highly charged in the second state. The squeegee roller has an increased voltage difference relative to the developer roller, leading to the ink being tackier in the second state. The developer voltage is increased relative to the photo imaging member, leading to an increased repulsion vector in the second state.

In some examples, the first state may have voltages as set out in table 1, and the second state may have one or more voltages as set out in table 2.

According to some examples, relative to the first state, the second state involves a change of only one or two of the developer roller 119, squeegee roller 520, and electrode 510. In other examples, all three voltages may be changed.

Where the second state has two or more sub-states, one or more of the voltages in table 2 may be used in one or more of the sub-states.

In some examples, the second state may include a gradual change from starting voltages (e.g. the voltages in the first state) to a target voltages (such as those in table 2).

The above examples described the transition from an image region 230 to a non-image region 250. However, similar approaches may be adopted for a transition from a non-image region 230 to an image region 250.

In the examples above, certain assumptions were made regarding the polarity of charges and voltages of the various elements. However, in other examples, the polarities may be reversed.

Figure 6:
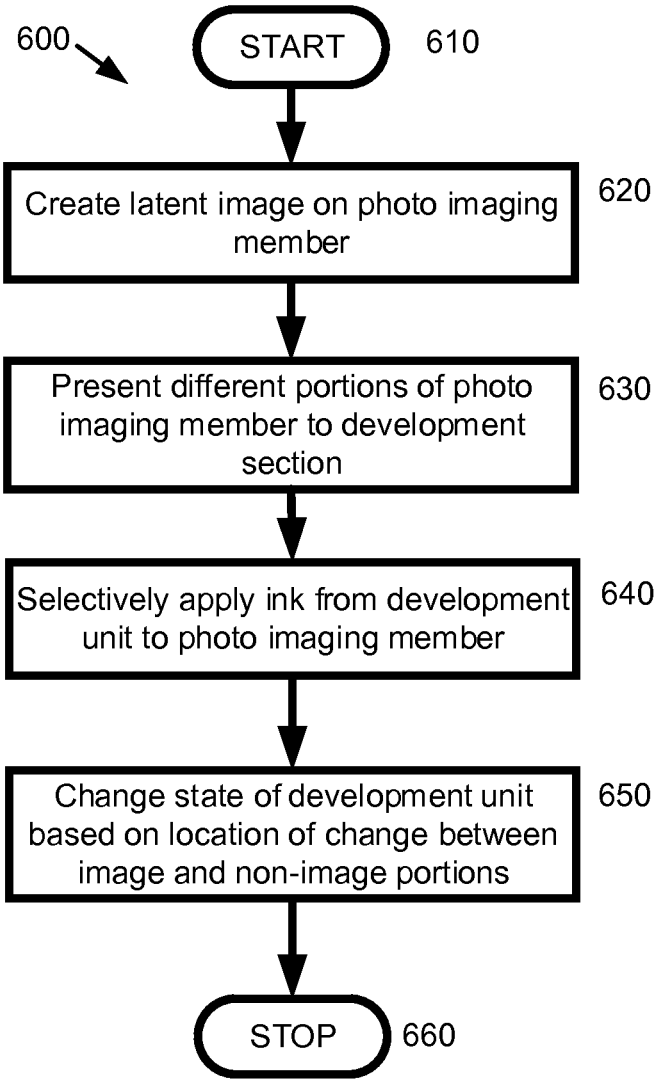
FIG. 6 shows an example of a method according to some examples.

FIG. 6 shows an example of a method 600 according to some examples. The method begins at 610, and at 620 a latent image is created on the surface 110 of a photo imaging member 112. At 630 the surface 110 of the photo imaging member 112 is moved relative to a developer unit 118 to expose different portions of the surface 110 to the developer unit 118. At 640 ink is selectively applied to the surface 110 by the developer unit 118. At 650 the state of the development unit 118 is changed based on a location of a transition between an image portion 230 and a non-image portion 250 of the surface 110 of the photo imaging member 112. The method terminates at 660.

Figure 7:
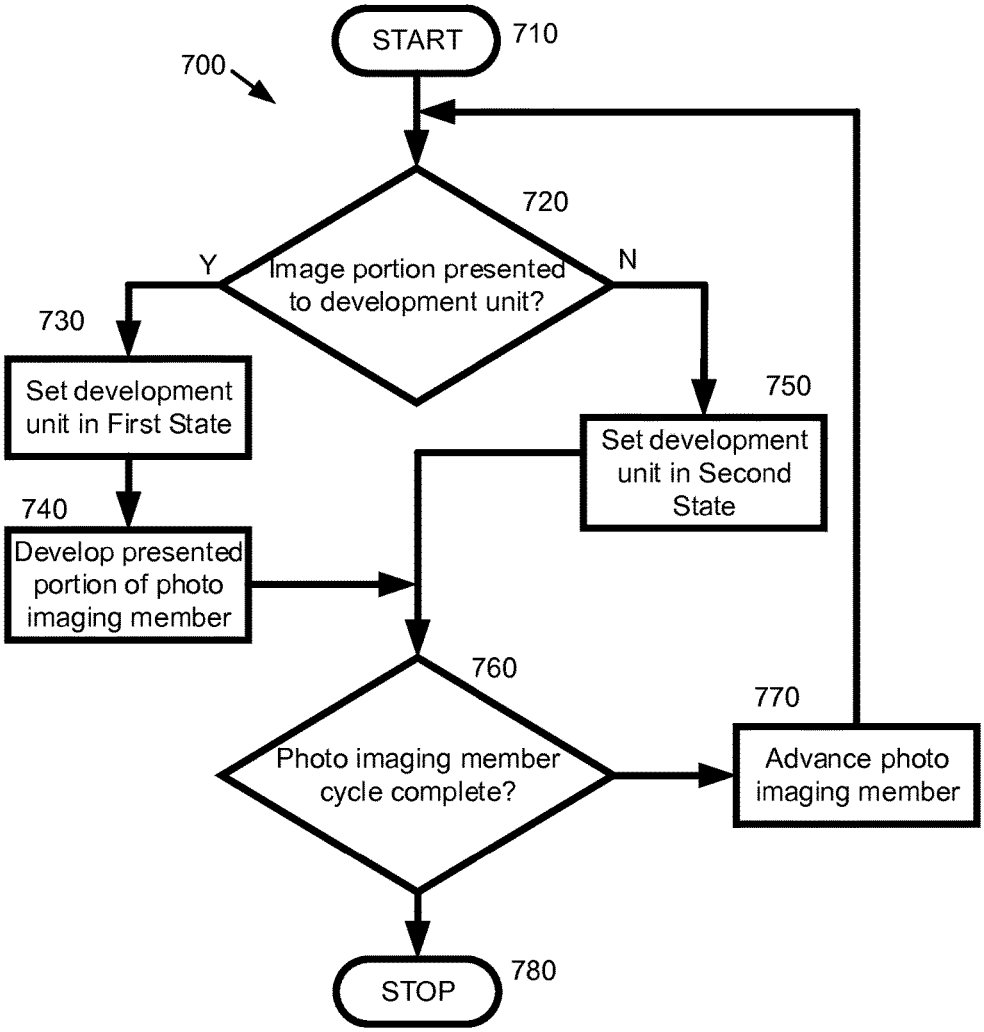
FIG. 7 shows an example of a method according to some examples.

FIG. 7 shows a method 700 according to some examples. The method begins at 710, and at 720 it is determined whether an image portion 230 is presented to the development unit 118 for development. More generally, it may be determined if an image portion 230 will be presented to the development unit 118 at a predetermined later time, or if an image portion 230 is at a predetermined location relative to the portion of the surface 110 of the photo imaging member 112 that is presented to the development unit 118.

If the determination in 720 is positive, the method proceeds to 730 and the development unit 118 selectively develops the image on the photo imaging member 112 at 740. The method then proceeds to 760. Where the determination at 720 depends on a portion of the surface 110 of the photo imaging member 112 that is not currently presented to the development unit 118, the developing in 740 may be delayed until that portion of the surface 110 is presented to the development unit 118.

Where the determination in 720 is negative, the method proceeds to 750, and the development unit 118 is set in the second state. Where the determination at 720 depends on a portion of the surface 110 of the photo imaging member 112 that is not currently presented to the development unit 118, the developing unit 118 may continue to develop the photo imaging member. The method then proceeds to 760.

At 760 it is determined whether or not the cycle of the photo imaging member 112 is complete. Where the cycle is not complete, the photo imaging member 112 is advanced (e.g. rotated) at 770, and the method returns to 720.

Where it is determined at 760 that the cycle is complete, the method terminates at 780.

It is to be understood that the method may be performed continuously, with various stages occurring simultaneously, or substantially simultaneously. For example, advancing 770 the photo imaging member 112 may include be moving the photo imaging member 112 continuously, and as the photo imaging member 112 moves, determining 720 if an image portion 230 is presented to the development unit 118.

Herein, unless otherwise specified or another meaning is apparent, references to lengths and distances in relation to the photo imaging member 112 (such as the length of the surface 110 of the photo imaging member 112 and the length of the latent image) relate to a length measured along the surface 110 of the photo imaging member 112 in a direction parallel to the direction of motion of the photo imaging member 112 (relative to the development unit 118 in order to present different portions of the surface 110 of the photo imaging member 112 to the development unit 118. As is clear from the example of FIG. 1, the relative motion between the photo imaging member 112 and the development unit 118 need not be linear motion, and in the example of FIG. 1 is rotational motion, such that lengths are measured around the circumference of the photo imaging member 112.

Herein, a spread is used to describe a portion of the substrate 240 that has been printed as a result of one transfer cycle of the photo imaging member. A transfer cycle of the photo imaging member is used herein to describe one cycle of the photo imaging member to transfer ink to the ITM 122 from the whole useable surface 110 of the photo imaging member 112. For example, in the arrangement of FIG. 1 a transfer cycle may include one revolution of the photo imaging member 112 for each development unit 118 to transfer ink from the respective development units 118 to the photo imaging member 112, and an additional revolution of the photo imaging member 112 to transfer ink to the ITM 122. In some arrangements, ink may be transferred to ITM 122 in the same revolution in which the last development unit 118 applies ink to the photo imaging member 112, and in such an arrangement, a transfer cycle may include a number of cycles equal to the number of development units 118.

FIG. 2 illustrated the image portion 210 of the photo imaging member as offset from both the leading and trailing edges of the surface 110 of the photo imaging member 112. However, the location of the image portion is not particularly limited, and for example may have a leading edge coincident with the leading edge of the surface 110 of the photo imaging member 112, or may have a trailing edge coincident with a trailing edge of the surface 110 of the photo imaging member 112. The leading edge of the surface 110 of the photo imaging portion 112 refers to the portion of the surface 110 of the photo imaging portion 112 that corresponds with the leading edge of a spread on the substrate 240. Similarly, trailing edge of the surface 110 of the photo imaging portion 112 refers to the portion of the surface 110 of the photo imaging portion 112 that corresponds with the trailing edge of a spread on the substrate 240.

Figure 8A:
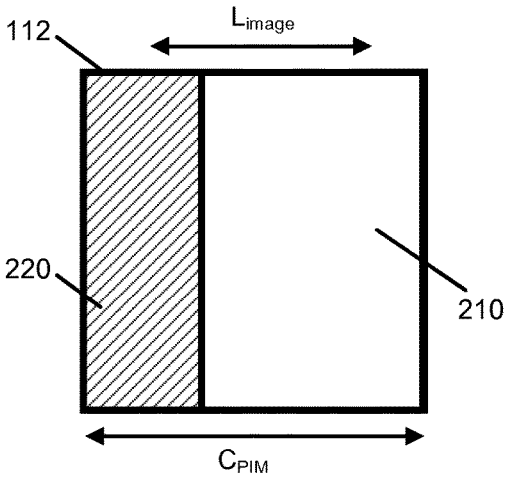
FIG. 8*a* illustrates an example with the leading edge of an image portion coincident with the leading edge of a photo imaging member.
Figure 8A:
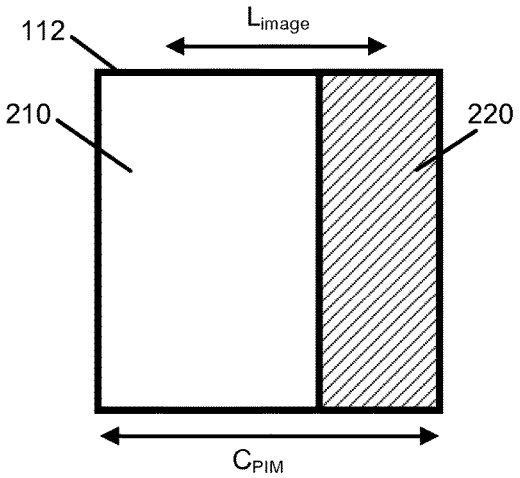

FIG. 8*a* illustrates an example with the leading edge of the image portion 210 coincident with the leading edge of the photo imaging member 112. FIG. 8*b* illustrates an example with the trailing edge of the image portion 210 coincident with the trailing edge of the photo imaging member 112. When these images are transferred to the substrate 240, the location of the image 230, 235 within the spread will correspond with the location of the image portion 210 on the surface 110 of the photo image member.

Herein, references to a portion of the surface 110 of the photo imaging member 112 being presented to a development unit 118 mean that that portion of the surface 110 of the photo imaging member 112 would receive ink from the active development unit 118 if the development unit 118 were engaged and if that portion of the surface 110 were to bear a part of the latent image that is to be developed. That is, a portion of the surface 110 of the photo imaging member 112 may be considered to be presented to the development unit 118 regardless of whether the development unit is engaged or disengaged, and regardless of whether or not the voltages applied to the components would cause transfer of ink to the photo imaging member 112. For example, the portion exposed to the development section 118 may be the portion in the nip 525 between development roller 119 and photo imaging member 112.

For simplicity, the examples of FIGS. 2 and 3 assumed that the same image was to be printed in each spread. However, in some arrangements different spreads may include different images. Moreover, the image lengths and/or repeat lengths may vary between spreads.

Throughout the description and claims of this specification, the words "comprise" and "contain" and variations of them mean "including but not limited to", and they are not intended to (and do not) exclude other additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers or characteristics described in conjunction with a particular aspect or example of the invention are to be understood to be applicable to any other aspect or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing examples. The invention extends to any novel one, or any novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

The invention claimed is:

1. A developing section for a digital printing press to apply an image to a web substrate, the developing section comprising:

a photo imaging member;

a development unit, to develop ink on the photo imaging member by applying ink to a surface of the photo imaging member that is presented to the development unit; and a controller to control the photo imaging member and the development unit, wherein the photo imaging member is to move relative to the development unit in a movement direction to present different portions of the surface of the photo imaging member for development by the development unit, the controller is to determine, based on an image to be developed, an image portion of the surface of the photo imaging member, the image portion corresponding with an extent, in the movement direction, of the image to be developed, and the controller is to control the development unit such that a configuration of the development unit is to be in a first state or a second state based on a determination by the controller comparing a location of the portion of the surface of the photo imaging member presented to the development unit with a location of a transition between the image portion and a portion of the surface of the photo imaging member not in the image portion and a circumference of the photo imaging member.

2. The developing section of claim 1, wherein the controller is to control the development unit such that a configuration of the development unit is to be in a first state when the portion of the surface of the photo imaging member presented to the development unit is determined by the controller to be the image portion, and the configuration of the development unit is to be in a second state when the portion of the surface of the photo imaging member presented to the development unit is determined not to be in the image portion by the controller.

3. The developing section of claim 1, wherein the development unit is engaged with the photo imaging member in the first state and disengaged from the photo imaging member in the second state.

4. The developing section of claim 1, further comprising an actuator to move the development unit between a first position and a second position; the first position corresponding to the first state and the second position corresponding to the second state.

5. The developing section of claim 1, wherein the development unit includes a charging component, the charging component is arranged to charge the ink by applying a first voltage to the ink in the first state, and the charging component is arranged to charge the ink by applying a second voltage, different from the first voltage, to the ink in the second state.

6. The developing section of claim 1, wherein the controller is to receive data describing a repeat length associated with the image to be developed, and to determine whether or not the portion of the photo imaging member presented to the development unit is in the image portion based on the repeat length.

7. The developing section of claim 5, wherein the controller is to receive an adjustment value, and to apply the adjustment value to the repeat length to determine the image portion.

8. The developing section of claim 1, wherein the controller is further to control the web substrate to reverse a distance determined based on the circumference of the photo imaging member.

9. A digital printing press to apply an image to a web substrate, the digital printing press comprising the developing section of claim 1.

10. A controller for a digital printing press to apply an image to a web substrate, the controller comprising:

outputs for control signals to a latent image bearing member and a developer unit, the latent image bearing member arranged to bear a latent image and the developer unit to apply ink to the latent image bearing member; and a processor to provide signals to the outputs to control the latent image bearing member and the developer unit, wherein the processor is to:

determine a portion of the latent image bearing member carrying the latent image, provide signals to the outputs to cause the latent image bearing member and the developer unit to move relative to each other to vary a part of the latent image bearing member that may receive ink from the developer unit, and provide signals to the outputs to cause the development unit to change between a first configuration and a second configuration based on a determination by the controller of the relative positions of the part of the latent image bearing member that may receive ink from the developer unit and a change between the portion of the latent image bearing member carrying the latent image and a portion of the latent image bearing member that is not carrying the latent image; and provide signals to the outputs to cause the web substrate to reverse a distance determined based on the circumference of the latent image bearing member.

11. A method for applying an image to a web substrate, the method comprising:

creating a latent image on a photo imaging member;

moving the photo imaging member relative to a development unit to present different portions of the photo imaging member to the development unit;

selectively applying, by the development unit, ink to the portion of the photo imaging member presented to the development unit;

transferring the selectively applied ink to the web substrate;

moving the web substrate in a first direction to form an image region and a non-image region corresponding to the ink selectively applied to the photo imaging member;

subsequent to forming the image region and the non-image region, moving the web substrate in a second direction, opposite the first direction; and changing a state of the development unit based on relative locations of the portion of the photo imaging member presented to the development unit and a change to or from a portion bearing the latent image.

12. The method of claim 11, further comprising:

receiving, by a control unit, data relating to the latent image; and determining, by a control unit, an extent of the latent image in a direction of the relative movement, wherein the changing that state of the development unit is based on the determining.

13. The method of claim 12, wherein the determining includes approximating a length of the latent image in a direction of the relative movement as being equal to a repeat length associated with the latent image.

14. The method of claim 11, wherein changing the state of the development unit comprises moving the development unit towards or away from to the photo imaging member.

15. The method of claim 11, wherein changing a state of the development unit comprises changing a voltage applied to the ink by the development unit, such that repulsion of the ink away from the photo imaging member is increased when the portion of the photo imaging member presented to the development unit is not a portion bearing the latent image, relative to when the portion of the photo imaging member presented to the development unit is a portion bearing the latent image.

* * * * *